United States Patent [19]

Tsiferov

[11] 3,934,659

[45] Jan. 27, 1976

[54] APPARATUS FOR DRILLING HOLES IN EARTH SURFACE

[76] Inventor: Mikhail Ivanovich Tsiferov, ulitsa Druzhinnikovskaya, 11a, kv. 22, Moscow, U.S.S.R.

[22] Filed: Apr. 15, 1975

[21] Appl. No.: 568,183

[52] U.S. Cl. ..... 175/14; 60/267; 175/15; 175/17; 175/93; 175/307; 175/318

[51] Int. Cl.[2] ..... E21B 7/14; E21C 21/00

[58] Field of Search ..... 175/2, 11, 12, 307, 14, 175/15, 17, 93, 422, 71.6, 318, 317; 173/DIG. 1

[56] References Cited

UNITED STATES PATENTS

| | | | |
|---|---|---|---|
| 1,661,091 | 2/1928 | Riabouchinski | 175/6 X |
| 2,218,130 | 10/1940 | Court | 175/422 X |
| 3,216,320 | 11/1965 | Thomas et al. | 175/4.5 X |
| 3,345,879 | 10/1967 | Nasu et al. | 175/6 X |
| 3,386,521 | 6/1968 | Chadderdon | 175/422 X |
| 3,389,759 | 6/1968 | Mori et al. | 175/422 X |
| 3,467,211 | 9/1969 | Goodwin et al. | 175/422 |
| 3,502,161 | 3/1970 | Coman | 175/4.57 |
| 3,620,313 | 11/1971 | Elmore | 175/93 |
| 3,881,561 | 5/1975 | Pols et al. | 175/422 |

*Primary Examiner*—Frank L. Abbott
*Assistant Examiner*—Richard E. Favreau
*Attorney, Agent, or Firm*—Holman & Stern

[57] ABSTRACT

The apparatus is a rocket with a drill head provided with a group of jet nozzles. One nozzle of this group is the face-forming one, while the plurality of the rows of the rest of the nozzles belong to imaginary circles concentric with the longitudinal axis of the rocket. The spacing of the nozzles in each row equals 4 to 7 critical diameters of the jet nozzle of the respective row, while the spacing of any pair of the adjacent rows of the nozzles in a projection of the drill head upon a plane perpendicular to the longitudinal axis of the rocket is 4 to 7 times greater than the mean diameter of the nozzles of the said pair of rows of nozzles.

8 Claims, 12 Drawing Figures

APPARATUS FOR DRILLING HOLES IN EARTH SURFACE

The present invention relates to improvements in apparatus for drilling holes in earth surface and can be widely utilized in geology, construction, agriculture and other fields, whenever a high rate of penetration is required.

The present invention can be used to utmost effectiveness in drilling holes, such as in charting, structural, stratigraphic, prospecting, and the like, which are drilled for geological charting, survey and prospecting for minerals and oil, as well as in drilling of production wells, of holes for studying the physical and mechanical properties of rock and soil, of hydrology wells for investigation of the quality and supply of ground water. Furthermore, the present invention can be utilized for drilling water level-lowering wells to bring down the head of ground water or else to reduce the inflow of water driving mine shafts, drifts and the like, of ventilation holes, of air supply holes for feeding air to fire faces in underground gasification of coal and for feeding the fuel gas to the surface. Moreover, the present invention can be utilized for drilling special-purpose wells, e.g. for supplying materials to fight underground fires, for leading power cables, water and air conduits to underground structures, to supply air and food and to bring out men in emergency in mines, for making underground gas and oil reservoirs. When utilized in agriculture, the present invention can be employed for supplying potable and industrial water, for land reclamation; in construction the invention can be used for drilling holes for bridge supports, for a variety of purposes in civil engineering, for making blast holes and the like.

At present, there are in existence numerous devices of various kinds for drilling holes in earth surface by means of rock-breaking tools such as drill bits brought into direct contact with the rock being broken.

Depending on the strength of the rock and the required rate of drilling there are used either drilling rings with metal bits or those with bits or those with bits made of extra-hard materials, such as diamond bits.

The use of rotary bits inadvertently puts a practical limit to the drilling rate, even when the bits employed are super-hard; thus with the speed of rotation being 600 revolutions per minute the drilling rate is about 40 m/hour. However, it is possible in principle to step up the drilling rate i.e. to increase it 2 or 3 times, although it affects the commercial aspects of the performance of drillings.

Increasing the rate of penetration at drilling of wells, particularly of great-diameter ones, involves increasing the capacity of the main and auxiliary equipment, which, in its turn, results in an increased weight of this equipment.

As long as most of the parts and units of a drilling rig are made of metal, an increased capacity means an increased amount of metal in the rigs, which is reflected in a substantially increased cost of manufacture. One should not overlook the fact that the greater the weight and bulk of a drilling, the less transportable it becomes. And, finally, among the disadvantages of the known well drilling devices is relatively rapid wear of the rock-breaking tools on account of a forceful contact and abrasion properties of the rock.

Thus, by employing the hitherto known drilling devices it is impossible at present to step up considerably the productivity of hole and well drilling.

I have offered a principally novel method of drilling holes in earth surface by acting upon the face of a hole with a dynamic gas jet continuously issuing from the jet nozzles of a drill head of a rocket which is maintained in a suspended state relative to the wall of the hole and moves in the direction of the face in the course of penetration.

Prior to the drilling operation the rocket is positioned with its drill head facing the face of the hole, the tip of the nozzle being spaced from the face by about four diameters of the nozzle. Thereafter the rocket is started and released, whereby the dynamic gas jet issuing from the jet nozzle acts upon the face. The rocket is pressed toward the face with a force slightly in excess of the reactive force of the dyanmic gas jet and of other forces directed in opposition to the required movement of the rocket. The broken rock is carried back from the hole by a stream of spent gas being discharged through the space between the wall of the hole and that of the rocket.

A rocket capable of performing this method includes a drill head situated in the leading or head portion of the rocket and provided with a group of nozzles to create a dynamic gas jet and means for generating gas under high pressure.

However, this rocket can be effectively used for drilling holes of diameters up to 300 mm. This is explained by the fact that when a hole being drilled has a diameter in excess of 300 mm the rocket is liable to get stuck in the hole adjacent to the face, since the hitherto disclosed arrangement of the jet nozzles in the drill head does not ensure uniform breaking of the rock throughout the face area.

It is an object of the present invention to create a rocket for drilling holes in earth surface, which should enable to increase the diameter of the holes that can be drilled.

This and other objects are attained in an apparatus for drilling holes in earth surface by acting upon the face of a hole with a dynamic gas jet, comprising a rocket with a generator of a gas under high pressure, having in the head portion thereof a drill head provided with a group of jet nozzles communicating with the gas generator to form a dynamic gas jet, the group including a central nozzle belonging to the longitudinal axis of the rocket and constituting the hole-face forming nozzle, in which apparatus, in accordance with the present invention, the rest of the jet nozzles of the group are arranged in a plurality of rows of these nozzles, belonging to imaginary circles spaced from one another longitudinally of the rocket, the spacing on any pair of the adjacent rows of these nozzles in a projection of the drill head upon a plane perpendicular to the longitudinal axis of the rocket being 4 to 7 times greater than the mean diameter of the nozzles of this pair of adjacent rows of nozzles, the spacing of adjacent nozzles in each row equalling 4 to 7 critical diameters of the nozzles of the respective row of these nozzles.

The above arrangement of the jet nozzle in the drill head provides for uniform breaking of the rock throughout the face area, which is of paramount importance in drilling holes having a diameter in excess of 300 mm. The abovespecified spacing of the rows of nozzles and of the nozzles in each row ensures performance ability of the rocket and enables to reduce the overall number of jet nozzles in the drill head, while maintaining high penetration rate irrespectively of the hole diameter.

I have established that maximal diameter of the rocket should be 0.5 to 0.7 of the hole diameter. Should the diameter be less than 0.5 of the hole diameter the supply of fuel per one metre length of the rocket will be reduced, resulting in shortened time of operation of the rocket (on account of rapid burning away of the fuel). With the diameter of the rocket exceeding 0.7 of the hole diameter, the pressure of gas under the rocket will force the rocket out of the hole.

It is expedient that in one of the rows of the jet nozzles there should be at least one pair of the nozzles diametrally opposing each other in this row and facing opposite directions in a projection of the row upon a plane perpendicular to the longitudinal axis of the rocket, to create a torque relative to this axis.

With the rocket rotating as it penetrates, the surface of the walls of the hole is improved.

When the weight of the rocket and its fuel is relatively small in comparison with the reactive force acting in a direction opposite to the face of the hole, it is expedient, in order to create an additional dynamic gas jet producing an additional force helping to retain the rocket in front of the face, that at least a pair of jet nozzles arranged diametrically opposite in one of the rows of the nozzles should be directed in opposition to the direction of the progress of the rocket.

Alternatively, when the weight of the rocket and its fuel is relatively great in comparison with the reactive force of the jet acting upon the face of the hole, it is expedient that all the jet nozzles of the drill head should face in the direction of the progress of the rocket, to form an additional dynamic gas jet propagating in the direction of the progress of the rocket, so as to create an additional force helping to retain the rocket above the face.

According to one of the embodiments of the invention, the apparatus includes at least one aerodynamic flap means in the form of trapezoidal plates mounted on the housing of the rocket and retainable in two positions in one of which the plates are pulled in to extend along the rocket and in the other of which the plates are projected to extend at an angle relative to the longitudinal axis of the rocket, to span the hole.

By means of the last-mentioned flap means it becomes possible to create an aerodynamic force necessary for retracting the rocket from the hole at minimal power expense; furthermore, with the rocket having a relatively great weight, the action of the flap helps to retain the rocket at required spacing from the face of the hole and to control the force pressing the rocket toward the face.

According to an embodiment of the invention, the drill head incorporates a cooling system including a vessel with a supply of coolant, accommodated within the housing of the rocket intermediate of the drill head and the gas generator, a passage being defined in the central portion of the vessel through which the gas can flow into the drill head, the end face of the vessel, remote from the drill head, being perforated to build up gauge pressure within the vessel and the opposite end face of the vessel being provided with ejection nozzles for injection of the coolant into the drill head.

Alternatively, the cooling system of the drill head can include a vessel with a supply of coolant, arranaged along the longitudinal axis of the rocket and defining with the housing of the latter an annular passage through which the gas can flow into the drill head.

As the gas jet is cooled, it becomes heavier and denser, whereby the intensity of rock desintegration is increased.

Moreover, the reduction of the temperature of the gas jet enables to use less expensive materials in the production of the jet nozzles and prolongs the life of the drill head, the life of the rocket as a whole being prolonged accordingly.

In certain applications of the present invention it is expedient that the trailing or tail portion of the rocket should have mounted therein an auxiliary gas generator associated with another group of jet nozzles of which some are arranged in the end face of the rocket, opposite to that with the hole-face jet nozzle, to create an additional force pressing the rocket toward the face of the hole, the rest of these auxiliary jet nozzles being arranged intermediate of the drill head and the aerodynamic flap means, to create pressure under the latter and thus to enable the rocket to retract itself from the hole.

The additional propelling means described hereinabove is required when the diameter of the rocket is relatively small, and the rocket is used for drilling deep holes, i.e. in cases when an additional source of energy is required.

Other objects and advantages of the present invention will become apparent from the following detailed description of embodiments thereof, with reference being had to the appended drawings, wherein:

FIG. 1 schematically illustrates a rocket for drilling holes in earth surface;

FIG. 2 depicts a projection of the jet nozzles of the drill head (as shown in FIG. 1) upon a plane perpendicular to the longitudinal axis of the rocket;

FIG. 3 schematically illustrates the drill head of a relatively light weight rocket;

FIG. 4 schematically illustrates the drill head of a relatively heavy weight rocket;

FIG. 5 schematically illustrates the drill head provided with jet nozzles creating torque relative to the longitudinal axis of the rocket;

Figure 1:
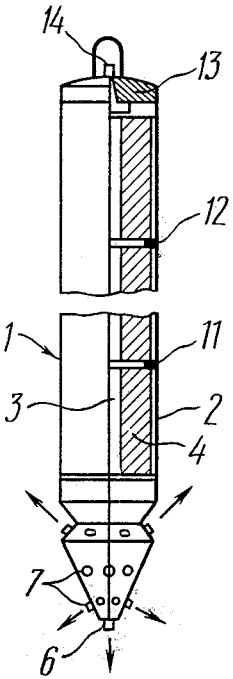

Referring now in particular to the appended drawings, the herein disclosed apparatus is a rocket 1 (FIG. 1) with a housing 2 accommodating therein a gas generator 3 with a supply of fuel 4. The head or leading portion of the rocket 1 carries a drill head 5. The drill head 5 may have different shapes, such as conical, cylindrical, etc. depending on the application of the rocket 1 and on the physical and mechanical properties of the rock to be drilled.

Figure 2:
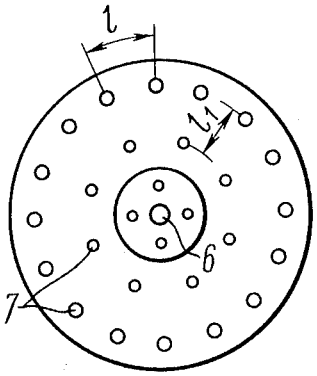

The drill head 5 is provided with a group of jet nozzles including a central nozzle 6 belonging to the longitudinal axis of the rocket 1 and being the hole-face forming nozzle, as well as several rows of jet nozzles 7 belonging to imaginary circles concentric with the longitudinal axis of the rocket 1 (FIG. 2). In each row the nozzles 7 are arranged at a uniform spacing $l$ equal to 4 to 7 critical diameters of the nozzles of the respective row. By the "critical diameter" I mean in the present disclosure the diameter of the minimal cross-section of the nozzle. The spacing $l_1$ between each pair of adjacent rows of the nozzles 7 in the projection of the drill head 5 upon a plane perpendicular to the longitudinal axis of the rocket is 4 to 7 times greater than the mean diameter of the nozzles 7 of this pair of rows.

The actual number of rows of the nozzles 7 and the actual values of the spacing $l$ and $l_1$ within the abovespecified range are selected to correspond to the physical and mechanical properties of the rock, to the hole diameter and to the jet energy of the gas issuing from each nozzle, to the temperature of the gas jet and to the geometry of the arrangement of nozzles 7 over the drill head 5.

In cases when the weight of the rocket and of its fuel supply is substantially less than the thrust of the jet engine, it is necessary to procure an additional force to press the rocket 1 to the hole face, i.e. to ensure a state when the forces pressing the rocket towards the face of the hole should be in excess of the sum total of the reactive force created by the dynamic gas jet, of the friction between the housing 2 of the rocket, the rock fragments and the flow of spent gas exiting through the annulus between the housing 2 of the rocket 1 and the wall of the hole.

Figure 3:
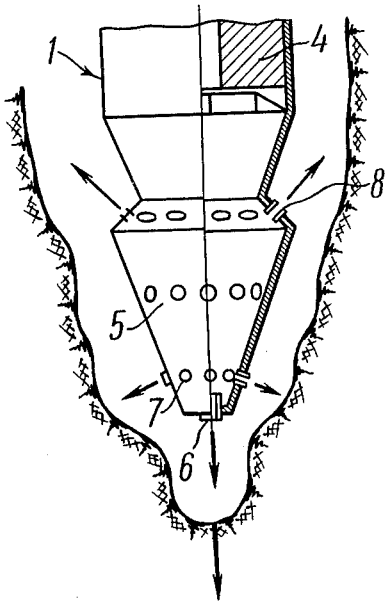

There is shown in FIG. 3 the drill head of a rocket of the abovespecified kind. At least one pair of jet nozzles 8 in the top row of the nozzles are arranged in diametrical opposition to each other and are facing in the direction opposite to the direction of penetration of the rocket 1.

The actual number of the nozzles 8 facing the direction opposite to that of the progress of the rocket 1 should be such that the resultant force of all the external forces acting upon the rocket 1 should be directed in the direction of the required progress of the rocket 1.

When the weight of the rocket 1 is relatively great with respect to the force of the reactive jets acting upon the face of the hole, it is necessary to form dynamic gas jets issuing in a direction coinciding with that of the progress of the rocket 1, to procure an additional reactive force helping to maintain the rocket 1 above the face.

Figure 4:
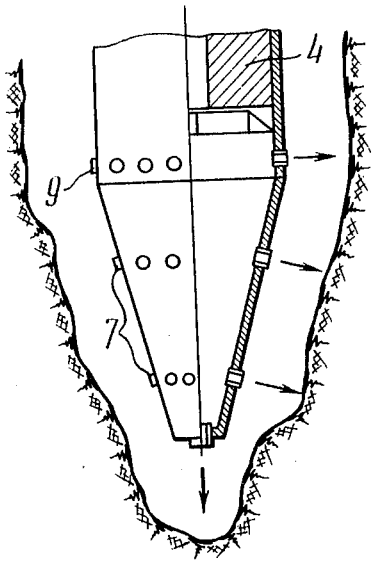

FIG. 4 of the appended drawings depicts the drill head 5 of the rocket of this kind. The majority of rows of the nozzles 7 of the drill head 5 are oriented in the direction of the progress of the rocket, whereas the nozzles 9 of the top row are directed normally to the progress of the rocket I to expand the hole. The actual value of the angle "$\alpha$" at which each respective jet issues from each nozzle 7, 9 of the drill head 5 is selected to achieve a maximum degree of rock desintegration and depends on the properties of the rock and the design of the rocket.

To obtain smoother surface of the walls of the hole it is expedient that the rocket 1 should rotate in operation about its longitudinal axis. This is attained by increasing the respective critical diameters of the nozzles and by providing at least in one of the rows of the nozzles 7 at least a pair of nozzles 10 arranged in diametral opposition to each other and facing opposite directions in a projection of the drill head 5 upon a plane perpendicular to the longitudinal axis of the rocket (see FIGS. 5 and 6). It is expedient that this pair or these pairs of the nozzles 10, as the case may be, should belong to the row of the nozzles arranged in the circle having the greatest diameter. This is explained by the fact that in this way the greatest torque is produced;

M equals $P \cdot l_3$, where P is the reactive force produced by a dynamic gas jet, $l_3$ is the spacing of a pair of nozzles.

The gas generator 3 (FIG. 1) in the presently described embodiments operates with solid rocket fuel accommodated within the combustion chamber 11.

The actual shape of the solid fuel charges and the composition of the fuel are known per se and are similar to the shape of the charges and the composition of the fuel used with rockets of other kinds. Whatever the embodiment of the herein disclosed rocket, the volume of gas produced by the gas generator 3 per unit of time, e.g. per second, should provide for drilling a hole of the required diameter and for the removal of broken rock over the entire cross-section of the hole.

To provide for uniform combustion of the fuel and for the specified production of gas by the gas generator 3 per unit of time, the supply of the fuel 4 is subdivided with spacer rings 12 made of a heat-resistant material, e.g. of steel, into severe compartments arranged within the combustion chamber 11 longitudinally of the rocket 1.

The combustion chamber 11 further accommodates a charge of an igniter substance 13 arranged adjacent to the ignition cylinders 14 mounted in the housing 2 of the combustion chamber 11.

Alternatively, the gas source within the rocket 1 may operate with liquid fuel with a corresponding oxidant; in other words, it may be any kind of fuel used in liquid-fuel rockets.

The trailing or tail portion of the rocket 1 has a yoke 15 mounted thereon for attachment of a cable 16 by means of which the rocket 1 can be reacted from a relatively shallow hole.

I have found that the maximal diameter of the rocket 1 should equal 0.5 to 0.7 of the diameter of the hole.

Reduction of the diameter below the above range is undesirable, since this results in reduction of the fuel supply per unit of length of the rocket, while increasing of the diameter above this range might result in the rocket being pushed out of the hole under the action of the pressure under the rocket.

Prior to starting, the rocket 1 is charged with the fuel 4 and positioned in guides 17 at a specified distance from the face of the hole to be (FIG. 7), with the drill head 5 bearing upon a support 18 made of a readily breakable material, e.g. wood or a plastic.

Figure 8:
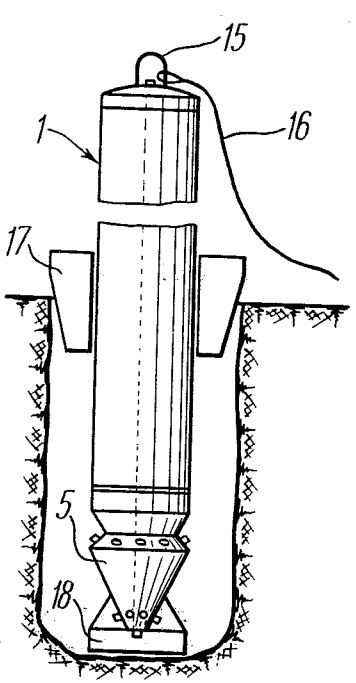
FIGS. 7 and 8 show a rocket in accordance with the invention in the starting position.

Alternatively, the rocket 1 prior to starting can be positioned in the guides 17 in a start up hole having a diameter equal to that of the hole to be drilled (see FIG. 8).

The ignition cylinders 14 are threadedly inserted into the housing 2 (FIG. 1) of the combustion chamber 11 and electrically connected to a power source (not shown). Upon the application of an electric pulse to the ignition cylinders 14, the igniter charge 13 is fired to ignite the fuel 4. The gas starts issuing from the jet nozzles of the drill head 5, and the rocket starts moving in the drilling direction, breaking the underlying rock and blowing the rock fragments out of the hole.

Figure 5:
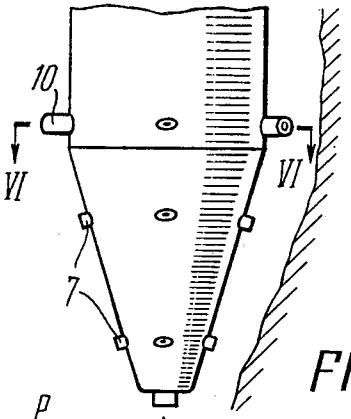
Figure 6:
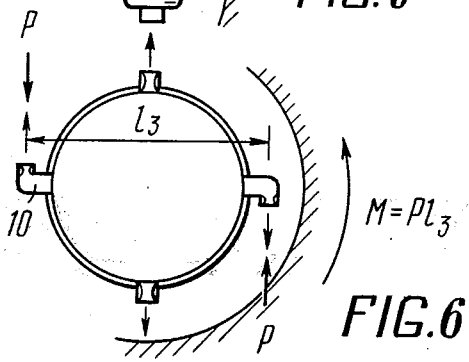
FIG. 6 is a sectional view taken on line VI—VI of FIG. 5.

When the design of the drill head 5 is that illustrated in FIGS. 5 and 6, the rocket also starts rotating about its longitudinal axis, providing for uniform desintegration of the wall rock in the hole being drilled.

After the rocket 1 has spent the entire supply of the fuel 4 calculated to enable the rocket 1 to drill a hole of a specified depth and diameter, the rocket 1 is pulled from the hole by the cable 16. After recharging it with the fuel 4 the rocket is ready for repeated use.

Figure 9:
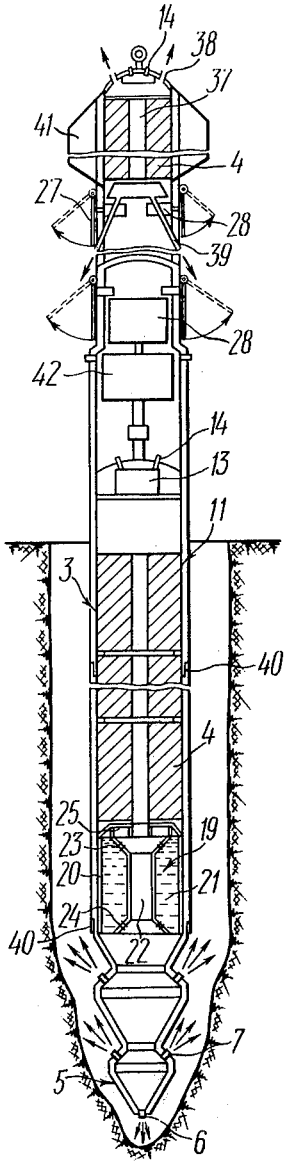
FIG. 9 is a longitudinally sectional view of a modification of a rocket in accordance with the invention.

There is shown in FIG. 9 of the appended drawings a modification of the structure of the herein disclosed rocket.

Figure 10:
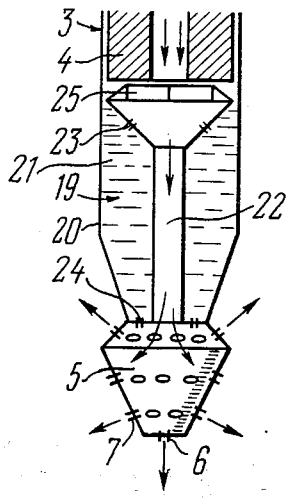

This modification of the rocket 1 incorporates a system 19 for cooling the drill head, mounted in the housing 1 of the rocket 1 intermediate of the drill head 5 and the gas generator 3. The cooling system 19 (FIG. 10) is in the form of a vessel 20 with the supply of coolant 21. Centrally of the vessel 20 along the longitudinal axis of the rocket 1 there extends a passage or conduit 22 for the flow of gas from the gas generator 3 into the drill head 5. The end face of the vessel 20, remote from the drill head 5 has perforations 23, so as to create pressure within the vessel 20, while the opposite end face of the vessel 20 is provided with ejector nozzles 24 for ejection of the coolant 21 into the stream of gas flowing into the drill head 5. A grid 25 is mounted between the gas generator 3 and the vessel 20, through which the gas flows toward the vessel 20. The grid 25 is provided to retain the fuel charge 4 within the combustion chamber 11 and to prevent clogging of the jet nozzles of the drill head 5.

Figure 11:
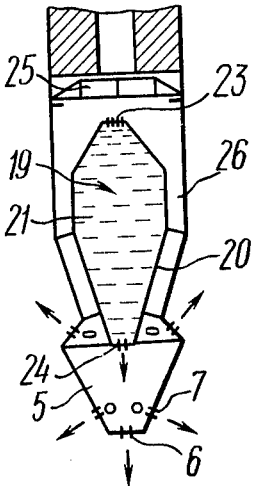
FIGS. 10 and 11 are schematic illustrations of the embodiments of the drill head cooling means.

Alternatively, the cooling system may be in the form of a vessel 20 with the supply of coolant 21, arranged along the longitudinal axis of the rocket 1 and defining an annular gap 26 with the housing 2 of the rocket 1 (see FIG. 11). The gap 26 provides a passage for the flow of gas toward the drill head 5. The perforations 23 in the vessel 20 with the coolant 21 (FIG. 10 and 11) are initially closed off with plugs (not shown in the drawings) made of a material which is readily meltable.

Figure 12:
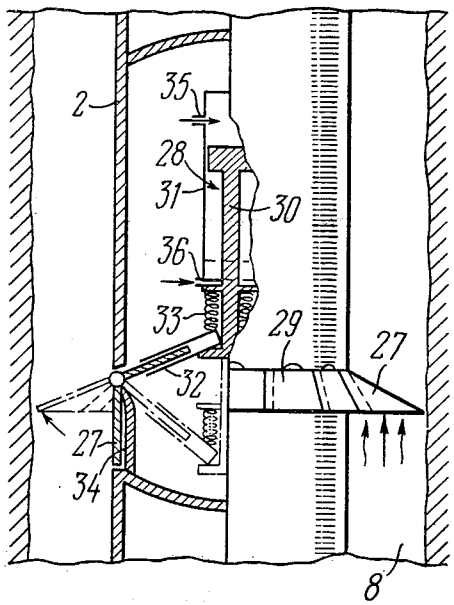
FIG. 12 shows schematically the aerodynamic flap means.

The housing 2 of the rocket 1 has mounted thereon an aerodynamic flap means 27 associated with a fluid actuator 28 (FIGS. 9 and 12). The aerodynamic flap means 27 is made up by trapezoidal plates 29 pivotally mounted on the housing 2 and retainable in two positions.

The fluid actuator 28 of the flap means 27 may include a plunger 30 reciprocable in a fluid cylinder 31, the free end of the plunger 30 being connected via an arm 32 with the plates 20. The arm 32 is urged by a spring 33, to dampen eventual impacts of the plates 29 against the wall of the hole.

In the unoperating position of the flap means 27, i.e. in the position corresponding to the rocket 1 penetrating the earth, the plates 29 of the flap means 27 are pulled in by the plunger 30 and are accommodated within an annular recess 34 provided in the housing 2; the operating position of the flap means 27 corresponds to retraction of the rocket 1 from the hole, in which case the fluid actuator 28 has an actuation command sent thereto, whereby compressed air is fed into the space in the fluid cylinder 31 above the plunger 30 through a connection 35, and the plunger is driven downward, displacing the arm 32. As a result the plates 29 of the flap means 27 are set at an angle to the longitudinal axis of the rocket 1, spanning the cross-section of the hole.

To pull in the flap means 27, compressed air is fed through a connection 36 into the space of the fluid cylinder 31 under the plunger 30, the connection 35 being in this case open to bleed air from the space above the plunger. The plunger 30 is driven upward, and the plates 29 are retracted into the annular recess 34.

In some cases, e.g. when the weight of the rocket is relatively great with respect to the thrust directed to retract the rocket from the hole, it is expedient to mount on the housing of the rocket several identical flap means, as shown in FIG. 9. With this structure, waste of energy on account of the gas bleeding through the annulus between the rocket 1 and the wall of the hole is minimized.

In one embodiment (see FIG. 9) there is mounted in the tail portion of the rocket 1 an auxiliary gas generator 37 having a structure identical to that of the abovedescribed gas generator 3.

The auxiliary gas generator 37 is associated with a group of jet nozzles of which some nozzles 38 are arranged in the end face of the rocket 1, opposite to the hole face of the nozzle 6, and are oriented in a direction opposite to that of the progress of the rocket 1, to create an additional thrust pressing the rocket 1 toward the face of the hole. Other nozzles 39 of the auxiliary generator 37 are mounted on the housing 2 of the rocket 1 intermediate of the aerodynamic flap means 27 and the drill head 5 and are oriented in the direction of the progress of the rocket 1, to create an additional thrust and pressure under the aerodynamic flap means 27, as the rocket 1 is being retracted from the hole.

With the length of the rocket 1 being relatively great, it may be expedient to make it of a sectional structure, so as to facilitate its transportation to the drilling site. In this case the rocket is assembled and secured together by means of couplings 40.

Stabilization of the desired direction of the progress of the rocket 1 in a hole is effected by means of a known per se gyroscopic system (not shown in the drawing) which is of any suitable kind used for similar purposes in known rockets and aircraft.

To stabilize the position of the rocket 1 relative to the walls of the hole, the rocket 1 is provided with stabilizers of fins including plates 41 mounted externally on the housing 2, symmetrically with respect to the longitudinal axis of the rocket 1.

The diameter of the rocket together with the stabilizers should be somewhat shorter than the calculated diameter of the hole being drilled.

The rocket 1 is provided with a program control unit 42 sending a succession of commands to control the operation of the rocket 1. The control unit 42 thus supervises the performance of the mechanisms and units of the rocket 1 in accordance with a preset program.

Figure 7:
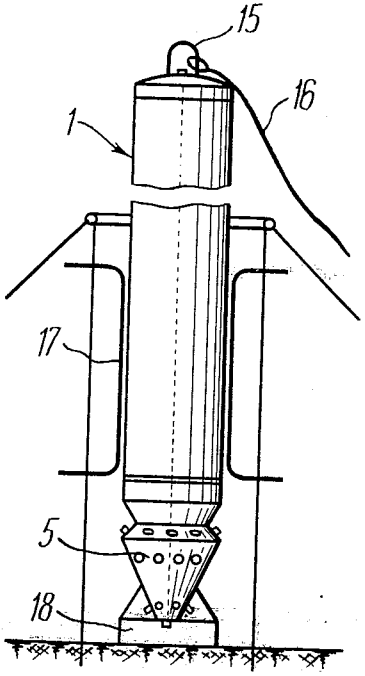

To operate the rocket, prior to its being started it is charged with fuel and positioned over the place to be drilled (see FIGS. 7 and 8). The ignition cylinders 14 are mounted in the housing of the combustion chamber 11.

Following a command sent by the program control unit 42, an electric pulse is sent to the ignition cylinders 14 from a power supply source (not shown).

The ignition cylinders 14 ignite the charge of the igniter 13 which ignites the fuel in the combustion chamber 11, whereby gas starts issuing in jets from the jet nozzles 6 and 7 of the drill head 5, and the rocket 1 starts moving toward the face of the hole breaking the rock and blowing the rock fragments out of the hole through the annular space between the rocket 1 and the wall of the hole. While passing through the vessel 20 with the coolant 21, the hot stream of combustion products destruct, e.g. by melting away, the plugs in the vessel 20. Following this, the coolant 21 is continuously injected from the ejector nozzles 24 into the stream of gas coming into the drill head 5.

The coolant 21 cools down the stream of gas coming to the drill head 5 to a temperature that can be withstood by the material of the jet nozzles 6 and 7. With the temperature of the stream being brought down, the stream becomes heavier which enhances its breaking ability:

$$\rho = \frac{\gamma \cdot V^2}{2}$$

where $\tau$ is speed-related head of the jet, kg/m$^2$, $\gamma$ is density of the gas jet, kg/m$^3$, V is speed of the gas jet, m/sec.

After the rocket 1 has either penetrated to a specified depth or has burnt away its supply of fuel 4 of the generator 3 or both, there is sent a signal to start the auxiliary gas generator 37. Simultaneously, there is sent a control signal to the fluid actuator 28 operating the aerodynamic flap means 27. The flap means 27 is projected to span the cross-section of the hole Jets of gas begin to issue from the jet nozzles 39, pressure builds up under the flap means 27, and the rocket 1 starts in a reverse direction toward the mouth of the hole. This reverse motion of the rocket 1 continues until the rocket 1 is within the hole. The moment the tail portion of the rocket 1 appears above the mouth of the hole, the pressure under the flap means 27 is relieved, and the rocket hangs in the mouth of the hole, since should it start falling into the hole the reappearing pressure ensured by the jet streams issuing from the jet nozzles 39 would prevent the rocket from moving into the hole any deeper than the mouth of the latter.

The advisability of providing the rocket with the auxiliary gas generator 37 is decided upon in accordance with the construction and applications of the rocket 1.

The provision of the auxiliary gas generator 37 proves to be most effective in rockets operating on solid fuel and used for deep drilling, since in this case an additional supply of fuel is required. Besides, it is quite expedient to use the auxiliary gas generator 37 with heavy rockets operating on liquid fuel, when the amount of gas produced per unit of time is not sufficient to create the necessary pressure under the flap means 27.

The jet nozzles 38 of the auxiliary gas generator 37 can be utilized to increase the thrust toward the face of the hole, e.g. when the progress of the rocket is directed from the centre of the earth and when horizontal holes are driven.

In embodiments when the structure of the herein disclosed rocket does not include an auxiliary gas generator 37, to retract the rocket from the hole the flap means 27 is projected with the gas generator 3 still operating, whereby pressure builds up under the flap means 27, and the rocket starts its reverse motion toward the mouth of the hole.

The rockets illustrated in FIGS. 1 to 9 are capable of drilling holes with diameters in excess of 250 mm and as deep as several hundred metres when a solid fuel is used; the use of a liquid fuel enables the rocket illustrated in FIG. 9 to drill to a practically unlimited required depth, i.e. to any depth where the walls of the hole can maintain their natural stability, and the temperature of the rock makes normal performance of the rocket possible.

What I claim is:

1. An apparatus for drilling holes in earth surface, including a rocket comprising: a generator of gas under high pressure; a drill head situated in the head portion of said rocket and including a group of jet nozzles communicating with said gas generator to create a dynamic gas jet acting on the face of the hole, said group of nozzles including a central nozzle belonging to the longitudinal axis of said rocket and being the hole-face nozzle and a plurality of rows of nozzles belonging to imaginary circles spaced from one another along the longitudinal axis of said rocket, the spacing between any adjacent pair of said rows of nozzles in a projection of sadi drill head upon a plane perpendicular to the longitudinal axis of said rocket being 4 to 7 times greater than the mean diameter of the nozzles of said adjacent pair of said rows of nozzles, the spacing between any two adjacent nozzles in each row being equal 4 to 7 critical diameters of the nozzles of said respective row.

2. An apparatus as claimed in claim 1, wherein one of said rows of said nozzles includes at least one pair of said nozzles arranged in diametrical opposition to each other in said one row and oriented in opposite directions in a projection upon a plane perpendicular to the longitudinal axis of said rocket, to create a torque with respect to this longitudinal axis.

3. An apparatus as claimed in claim 1, wherein, in order to provide an additional dynamic gas jet creating an additional force helping to maintain the rocket above the face of the hole, at least one pair of said nozzles is arranged in diametrical opposition to each other in the respective one of said rows of said nozzles aand are oriented in a direction opposite to that of the progress of said rocket.

4. An apparatus as claimed in claim 1, wherein all said nozzles of said drill head are oriented in the direction of the progress of said rocket.

5. An apparatus as claimed in claim 1, having at least one aerodynamic flap means including trapezoidal plates mounted on the housing of said rocket and retainable selectively in two positions in one of which said plates extend longitudinally of said rocket and in the other of which said plates extend at an angle to the longitudinal axis of said rocket, spanning the cross-section of the hole being drilled.

6. An apparatus as claimed in claim 1, including an auxiliary gas generator arranged in the tail portion of said rocket and associated with a group of jet nozzles of which some are arranged in the face of said rocket, opposite to said hole-face nozzle thereof, to create additional thrust and of which the other nozzles are arranged intermediate of said drill head and said aerodynamic flap means to build up pressure under the latter.

7. An apparatus as claimed in claim 1, including a system for cooling said drill head, including a vessel with a supply of a coolant, arranged within the housing of said rocket intermediate of said drill head and said gas generator, a conduit offering a flow passage for the gas to flow toward said drill head extending centrally of said vessel, the end face of said vessel, remote from the drill head, having perforations to create pressure within said vessel, the opposite end face of said vessel being provided with ejector nozzles for injecting the coolant into the flow of the gas coming into said drill head.

8. An apparatus as claimed in claim 7, wherein said cooling system for cooling said drill head includes a vessel with a supply of coolant, arranged along the longitudinal axis of said rocket and defining, together with the housing of said rocket, and annular passage through which the gas flows toward said drill head.

* * * * *